US009481922B2

(12) United States Patent
Vanek et al.

(10) Patent No.: US 9,481,922 B2
(45) Date of Patent: Nov. 1, 2016

(54) PROCESS FOR FORMING POROUS METAL COATING ON SURFACES

(76) Inventors: Yitzhak Vanek, Santa Cruz, CA (US); Leonardo Mendelovici, Santa Cruz, CA (US)

( * ) Notice: Subject to any disclaimer, the term of this patent is extended or adjusted under 35 U.S.C. 154(b) by 223 days.

(21) Appl. No.: 13/523,866

(22) Filed: Jun. 14, 2012

(65) Prior Publication Data

US 2012/0321812 A1 Dec. 20, 2012

(51) Int. Cl.
*C23C 4/06* (2016.01)
*C23C 4/18* (2006.01)

(52) U.S. Cl.
CPC *C23C 4/18* (2013.01); *C23C 4/131* (2016.01)

(58) Field of Classification Search
CPC ..... C23C 4/125; C23C 4/18
USPC ..... 427/449, 452, 456
See application file for complete search history.

(56) References Cited

U.S. PATENT DOCUMENTS 4,596,189 A * 6/1986 Halpern et al. ..... 101/458
6,123,999 A * 9/2000 Felix et al. ..... 427/449
6,280,796 B1 * 8/2001 Kloft et al. ..... 427/456
6,361,877 B1 * 3/2002 Miyai et al. ..... 428/546
6,465,052 B1 * 10/2002 Wu ..... H05H 1/24 427/201
2006/0110620 A1 * 5/2006 Lin ..... C23C 4/02 428/650
2008/0026248 A1 * 1/2008 Balagopal et al. ..... 428/688
2009/0029155 A1 * 1/2009 Gothlich et al. ..... 428/336
2009/0185968 A1 * 7/2009 Galligan et al. ..... 423/219
2011/0094629 A1 * 4/2011 Fang et al. ..... 148/241

* cited by examiner

*Primary Examiner* — Alexander Weddle

(57) ABSTRACT

Embodiments of the invention provide a thermal spray method of forming a protective and porous coating over desired surfaces. Further, embodiments provide a thermal arc spray method, such as twin wire arc spray, to coat the surfaces. The invention may refer to using Aluminum and Silicon alloy in a twin wire arc spray method, to create sacrificial and protective coatings on the surfaces, such as substrates and machine parts. Machine parts may be, for example, of sputtering system. The method may utilize a predefined range of Silicon to be alloyed with Aluminum to improve the physical properties of the Aluminum, and further avoid damages to the coated surface, such as delamination and flaking of the coatings and coated surfaces. Additionally, generation of defects during a sputtering process may be efficiently reduced.

17 Claims, 7 Drawing Sheets

Section A-A

PROCESS FOR FORMING POROUS METAL COATING ON SURFACES

FIELD OF THE INVENTION

This invention is generally related to coating of a material on a substrate and more specifically related to forming porous metal coating of Aluminium and its alloy using Twin Wire Arc spray coating.

BACKGROUND FOR THE INVENTION

The sputtering process is used in various industrial manufacturing processes, such as in semiconductor integrated circuits and magnetic media, to create sacrificial and protective coatings on various parts of the sputtering machine. These protective coatings serve to protect and extend the service life of some critical machine parts, such as those of sputtering system. The machine parts can be, for example, shields, wafer carriers, and disk carriers. Further, the protective coatings can also be produced by various methods including electroplating and thermal coating methods, such as twin wire arc spray, flame spray, and plasma spray.

During the sputtering process, one of the main problems is the generation of particles caused by de-lamination and flaking of the coated surfaces. Such flaking and de-lamination generate defects on the surface of the substrates, such as Silicon wafers and magnetic disks.

Aluminium, produced by thermal spray methods, is one of the most common protective coatings deposited on the surface of the sputtering machine parts. Although Aluminium generally has a beneficiary effect, the physical properties of the Aluminium protective coating and sputtered material cause de-lamination and flaking, which further result in particles with the detrimental effect as described above.

Efforts are made to reduce the detrimental effects of the sputtered Aluminium material. The physical properties of the Aluminium material are modified by adding another element, i.e., Silicon ('Si'), in various amounts to create a better consistency of the physical properties. Specifically, consistent with the thermal properties, between the Aluminium-Silicon protective coating, the sputtered material, and the part substrate, in order to reduce the de-lamination and flaking that result in generation of particles.

Attempts are made to create the protective coating by twin wire arc spray using Aluminium-Silicon wires of various compositions of Si, such as Al-6% Si. The results were not good enough. As well known, the thermal spray coating creates a columnar porous structure. However, in the case of the 6% Si, the structure of the porous frame was not rigid enough, basically due to the strength of the material, which further caused breakage and collapse of the coating. Thereby, resulting in flaking.

SUMMARY OF THE INVENTION

Embodiments of the invention provide a process for forming a porous metal coating on a substrate. The process comprises, thermally spraying the metal on the substrate to produce a metal coating over a surface of the substrate, and then, mechanically treating the metal coating to remove loose particles providing a finishing to the surface, thereby rounding sharp edges and reopening pores in the metal coating to render a smooth high surface area coating; wherein the metal sprayed onto the substrate is alloyed with Silicon in the range of 5% to 15%.

Further, embodiments of the invention provide a device for forming a porous metal coating on a substrate. The device includes a nozzle for thermally spraying a metal alloy on the substrate for producing a metal coating. The sprayed metal alloy includes silicon in the range of 5% to 15% of weight of the metal alloy. Herein, the metal coating may be treated to remove loose particles providing a finishing to a surface of the substrate, thereby sharp edges being rounded and pores in the metal coating being re-opened to render a smooth high surface area coating.

Here, the diameter of the nozzle is of about 1.5 mm. Further, the nozzle sprays the metal, on the substrate, in a chemically reducing atmosphere.

An aspect of the invention provides the main advantage in using Aluminium—12% Silicon is the combination of improved material properties for the specific application together with suitable process parameters. The 12% Si is used to create a rigid porous structure, from which high roughness (high profile) coating is developed as required (600-900 Ra) with smooth morphology (low profile). This prevents breakage of the structure while holding the sputtering layer and preventing the release of flakes and particles.

An aspect of the invention provides the metal, to be coated over the surface during the process, is sprayed in form of a wire. Further, the diameter of the wire is in the range of 14 to 16 gauges. Another aspect of the invention provides that the metal is sprayed in form of a powder metal. A yet another aspect of the invention provides the metal is sprayed in form of a molten metal.

According to another aspect of the invention, the surface to be coated is activated and cleaned prior to or simultaneously with being thermally coated.

According to additional aspect of the invention, the surface preparation, the thermal spray and posterior mechanical treatment are conducted, so as to achieve a roughness root mean square height of the metal coating in a range from 600 to 1500 micro inches. Additionally, the preparation of the surface utilizes high pressure rinse techniques.

A yet another aspect of the invention provides the thermal spraying is conducted in a non-oxidizing atmosphere. Alternatively, the spraying is conducted in a chemically reducing atmosphere.

Appropriate parameters are used for creating a metal coating implementing the thermal spray methods. An aspect of the invention provides the thermal spraying to be accomplished by electric-arc spraying with an arc current in the range of 35 to 200 amperes D.C. and with arc voltage from 15 to 50 volts D.C. Further, another aspect of the invention for the parameters provides a carrier gas, to be used in the thermal spraying process, that is maintained at a pressure within range of about 400 to about 800 KPa.

According to an aspect of the invention, the origin of the spray is from 10 to 25 cm, from the surface to be coated and the angle of the spray to the surface is from 60 to 120 degrees.

Conclusively, according to an aspect of the invention, the process is conducted in a manner so as to form a spray metal coating of 100 to 300 micrometer. Further, additional aspect provides the porous metal coating has porosity from 40 to 80 volume %.

BRIEF DESCRIPTION OF THE DRAWINGS

This invention is illustrated in detail in FIGS. 1 to 6. The diagrams are designed to illustrate the essence of the invention as well as a number of different preferred configurations for this invention. However, they shall not limit the range of possible configurations.

DETAILED DESCRIPTION

This disclosure describes the subject matter for patenting with specificity to meet statutory requirements. However, the description itself is not intended to limit the scope of this disclosure. The principles described herein may be embodied in many different forms.

Illustrative embodiments now will be described more fully hereinafter with reference to the accompanying drawings, in which some, but not all embodiments are shown. The embodiments described herein are provided so that this disclosure will satisfy applicable legal requirements. Like numbers refer to like elements throughout.

The present invention relates to a process and device for creating a protective metal coating on a substrate. This protective coating is created by twin wire arc spray using metal—Silicon wires having a definite proportion of Silicon ranging from 5% to 15%. The metal used for coating can be chosen from a group consisting of Aluminium, titanium, copper, nickel and their alloys. In an embodiment, the protective coating was created by twin wire arc spray using Aluminium-Silicon wires of Al—Si 12%. The main idea behind using Al—Si 12% is the combination of improved material properties for the specific application together with suitable process parameters. This brings the coating (with Al—Si 12%) to a high level performance for the application in place. Specifically, it controls uniformity and reduces the number of defects on sputtering substrate layers.

In an embodiment, a high surface area porous coating may be created by choosing appropriate parameters along with proper finishing. In an embodiment, the finishing is achieved by using one of $CO_2$, Nitrogen, and Ultrasonic cleaning. A high surface area porous coating having high volume pores in the arc sprayed area (~80%) may be created by creating two layers of coating in a two-stage process. In first stage, a very fine layer may be created to achieve good adhesion and bonding to the substrate. In second stage, a very porous layer with high roughness may be created. The porous layer with high roughness may capture floating particles and enable the particles to stick in a stable structure for a longer cycle time in the sputtering tool. Further, by using $CO_2$/Nitrogen/Ultrasonic, maximum porous volume clean sites may be created to enable more volumetric capacity on the arc sprayed material.

Figure 1:
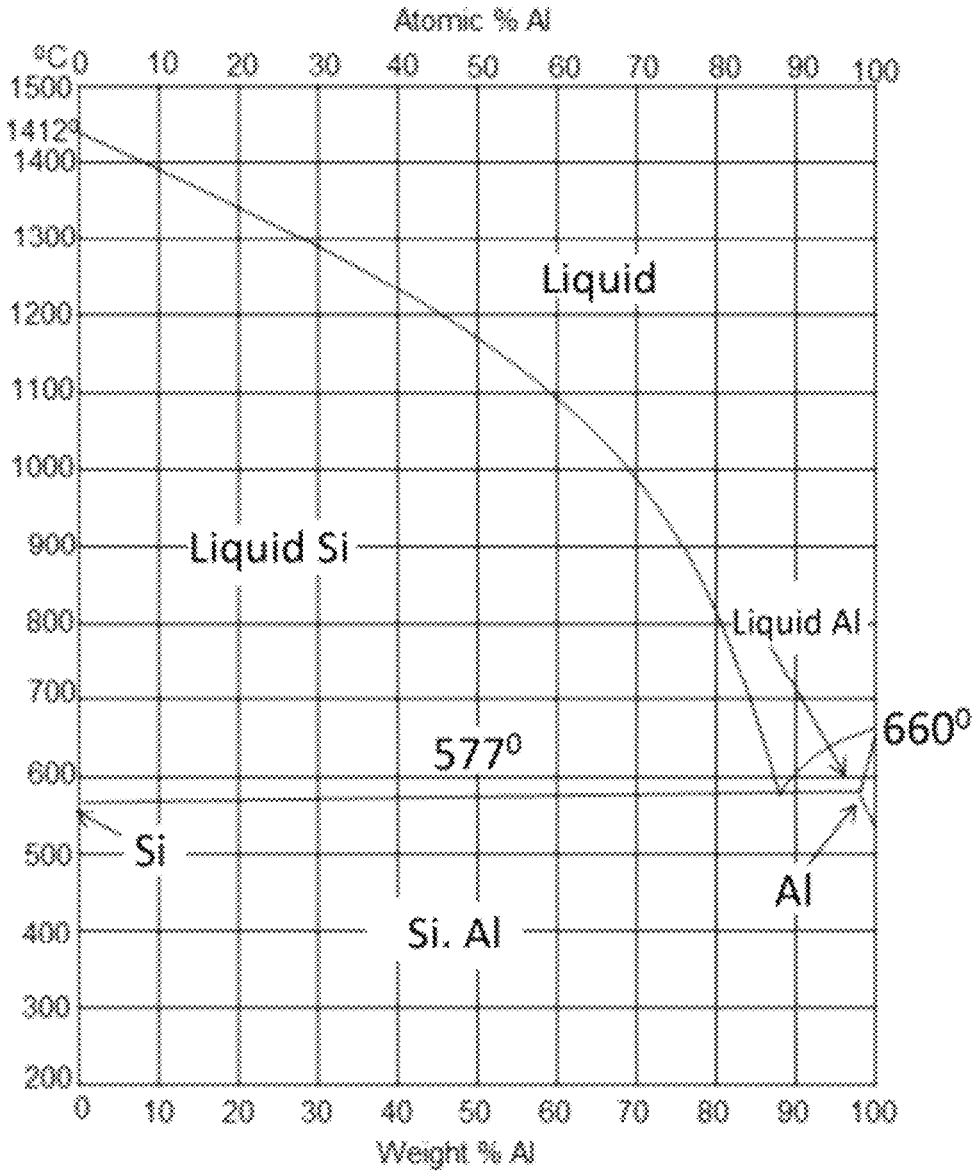
FIG. 1 illustrates phase diagram of Al—Si system with a minimum melting point at about 12% Silicon, in accordance with an embodiment of the invention.

Referring now to FIG. 1 that illustrates phase diagram of Al—Si system with a minimum melting point at about 12% Silicon, in accordance with an embodiment of the invention. The thermal spray method such as 'Twin Wire Arc Spray' method may be used to create porous material coatings over desired surfaces. The materials for coating over the surfaces may be metals, alloys, ceramics, and the like. In an embodiment, the metal may be fed in the form of wires in a thermal arc machine, and sprayed on the surfaces. In another embodiment, the metal may be fed in the form of powder metal. In a yet another embodiment, the metal may be fed in the form of molten metal, to be sprayed on the surfaces. In an embodiment, where the metal to be sprayed on the surface is in the form of wires, the diameter of the wire may be in the range of 14 to 16 gauges.

During the thermal spraying process, the protective coating may be created by twin wire arc spray using Aluminium-Silicon wires of Al—Si 12%. Addition of Si lowers the melting point of Al (as shown in FIG. 1). Further, as shown, the melting point of alloy with Al—Si 12% is about 575° C. This low melting point due to addition of Si allows for high fluidity on surface of the substrate. The molten metal alloy (Al—Si 12%) may be propelled or sprayed towards the surface to be coated. In an embodiment, the origin of the spray is from about 10 to 25 cm from the surface to be coated and the angle of the spray to the surface is from about 60 to 120 degrees. Further, such high fluidity on the surface allows for uniform and smoother deposition of the metal alloy.

Various metals may be used for the porous metal coatings over the machine parts. In an embodiment, the metal to be thermally sprayed over the surfaces of substrates or machine parts may be Aluminium and its alloys. In an embodiment, the metal to be thermally sprayed over the surfaces may be titanium and its alloys. In another embodiment, the metal to be thermally sprayed over the surfaces of substrates or machine parts may be copper and its alloys. In yet another embodiment, the metal to be thermally sprayed over the surfaces of substrates or machine parts may be nickel and its alloys. In an embodiment, the metal may be alloyed with Silicon. In another embodiment, Silicon may be added within in the range of 5% to 15% of the alloy.

Further, as mentioned above, thermal spraying processes may be used to coat the surfaces with porous metal coatings. Thereafter, when a porous metal coating may be created on the surface, various additional mechanical treatments of the sprayed coating may be adopted to accomplish surface finishing to remove any loose particles. Thereby, sharp edges of the coating may be rounded and some of the pores may be opened to render a smooth high surface area coating.

In an embodiment, twin wire arc spray method may be used to create a base coating prior the main coating in order to improve adhesion over the machine parts. This can be achieved in a two-stage process as described previously. A twin wire arc spray method may use two different kinds of electrically conducting wires, where an arc may be created by short circuiting the two wires proceeding towards each other. The high temperature of the arc may melt the metal wire tips. A compressed gas may atomize the molten wire tips and propel the droplets towards a surface or substrate to be coated. In an embodiment, the twin wire arc machine may originate spray of metal from about 10 to 25 cm from the surface to be coated and the angle of the spray to the surface is from about 60 to 120 degrees. In an embodiment, twin wire arc spray method may be used to produce the protective coatings using a combination of metals such as Aluminium, Copper, Titanium, Nickel or alloys of these metals containing small amounts of other element such as Silicon, Manganese, Carbon and the like. Aluminium-Silicon wires, where the Silicon may be added in various amounts. In another embodiment, the Silicon may be alloyed with Aluminium in the range of 5%-15% that may be used as one of the wires while the second wire may be pure Aluminium or any of the metals (as mentioned above) in pure or alloyed form. In a preferred embodiment, the quantity of Silicon in the Al—Si alloy may be 12% of the alloy. Resultantly, the performance of the protective coating made from combination of metals, as indicated above, may result in a protective coating, with improvement in physical properties to a greater extent of robustness to thermal stress, better uniformity of the protective coating over the machine parts and further, may reduce the number of defects on the substrate layers during the sputtering process.

Further, addition of the Si in the Aluminium to create a protective coating may lower the melting point of Aluminium, as shown in the FIG. 1. In an embodiment, the melting point of the Al—Si alloy may be approximately 575 degrees Celsius. Further, as compared to Al coating, the Al—Si alloy may be harder (HV~430 MPa), slightly lower in density (~2.65 g/cm$^3$) and may have higher Young's modulus (~75 GPa). Furthermore, the alloy may pose good resistance to corrosion and wear. Additionally, the alloy may have a lower thermal expansion.

The 12% Si may be used to create a rigid porous structure, from which a high roughness (high profile) coating may be developed. In an embodiment, the roughness of the coating may range from 600-900 Ra. This may further lead to a protective coating with smooth morphology (low profile), which may help in preventing breaking of the porous structure while holding the sputtering layer. Further, the release of flakes and the particles in a sputtering environment may be greatly reduced.

Furthermore, for thermal spraying processes, such as twin wire arc spray method, where an electric arc may be used to melt the metals (or alloys), appropriate working parameters may be chosen before carrying on the process of coating. In an embodiment, a voltage range of the arc may be in the range of 15-50 volts D.C. In a preferred embodiment, the voltage for the arc may be 40 V. In an embodiment, a current range of the arc may be in the range of 35-200 amperes D.C. In a preferred embodiment, the current for the arc may be 60 A DC. Further, in an embodiment, the carrier gas or compressed air pressure may be in the range of 400-800 KPa. In a preferred embodiment, the compressed air pressure may be 550 KPa for the Arc Spray Machine to carry out the process.

Further, the thermal spray processes used for creating a porous metal coating over the desired surfaces may be executed in controlled atmospheres. In an embodiment, the thermal spraying methods, such as twin wire arc spray method, may be conducted in a non-oxidizing atmosphere. In a further embodiment, the thermal spraying methods, such as twin wire arc spray method, may be executed in a chemically reducing atmosphere. Further, the process may furnish a fine coating over the surface, which may protect the surface against damages such as de-lamination, flaking, corrosion, warping of the surfaces. In an embodiment, the process may be conducted to form a spray coating of about 100 to 300 micro meter.

Conclusively, thermal spray processes, such as twin wire arc method, may be successfully used to create a porous metal coating over the surfaces of substrates, or machine parts. In an embodiment, the porosity of the coating may lie within the range of 40 to 80 volume %.

Figure 2:
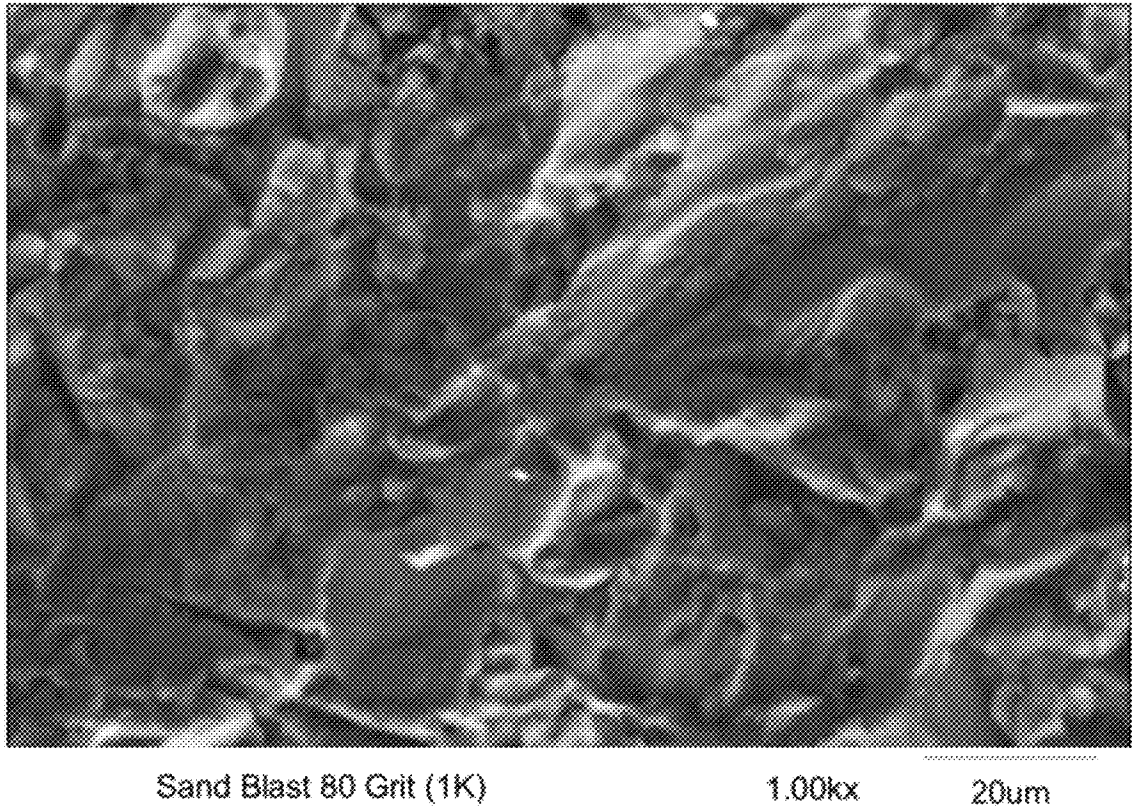
FIG. 2 illustrates SEM micrograph of a machine part surface after sand blasting, before Twin Wire Arc Spray coating method, in accordance with an embodiment of the invention.

FIG. 2 illustrates SEM micrograph of a machine part surface, such as carrier surface, after sand blasting, and before a thermal arc spray method, such as Twin Wire Arc Spray Coating, in accordance with an embodiment of the invention. Various cleaning or etching methods may be used in thermal arc spray coating methods, to activate and clean the surface to be coated before thermally creating a protective coating over the surfaces. In an embodiment, the cleaning may be done simultaneously with the thermal spray process. In an embodiment, the cleaning method may include sand blasting. During sand blasting, very fine bits of a material may be propelled at a very high speed towards the surface to be cleaned. Coating processes may adopt cleaning methods to finely clean the surface, in order to avoid hindrances during the coating process and attain uniformity in the protective coating.

Therefore, in an embodiment, sand blasting may be used to clean surface of a machine part, such as a carrier surface, to furnish a high profile to the surface, as shown in the FIG. 2, before creating a protective coating over the carrier surface, using twin wire arc spray method. After sand blasting of the surface, the roughness of the carrier surface may lie within in the range of 150-350 Ra. Here, 'Ra' is the unit to specify the roughness coefficient after sand blasting. Higher value of the roughness coefficient specifies that the surface is rougher.

Figure 3:
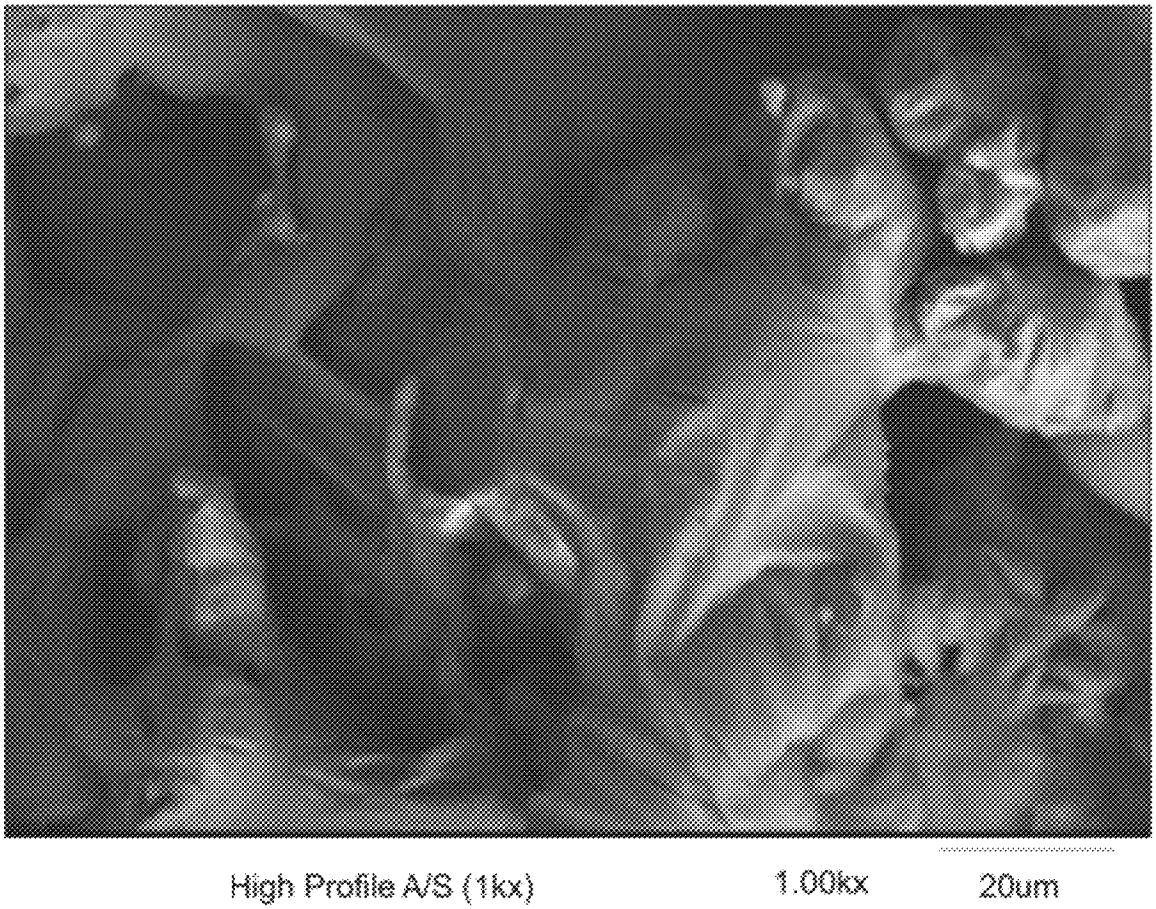
FIG. 3 illustrates SEM micrograph of a carrier surface, coated using Twin Wire Arc Spray with Al-12% Si coating, in accordance with an embodiment of the invention.

FIG. 3 illustrates SEM micrograph of a carrier surface, such as surface of a machine part, coated using a thermal process, such as a Twin Wire Arc Spray with Al-12% Si coating, in accordance with an embodiment of the invention. In an embodiment, after performing sand blasting on the surface of a required machine part, twin wire arc spray method may be adopted to coat the surface with the protective coating, where Al and Si wires may be used, with 12% Si. The surface may be depicted through an SEM micrograph as represented by the FIG. 3. Further, the process may adopt two arc sprays of coating over a required surface, such as the carrier surface, utilizing the Al—Si (12%) alloy. In the first arc spray, a very fine layer may be created to achieve good adhesion and bonding to the surface. In an embodiment, the roughness of the surface, such as carrier surface, may be within in the range of 200-400 Ra after first arc spray. Thereafter, in the second arc spray, a very porous layer with high roughness may be produced, that may capture floating particles and let them stick in a stable structure for a longer cycle time in a machine system, such as sputtering tool, as compared to the earlier process with a standard Al wire. In an embodiment, the roughness of the surface, such as carrier surface may be within in the range of 600-1100 Ra, after the second arc spray.

Figure 4:
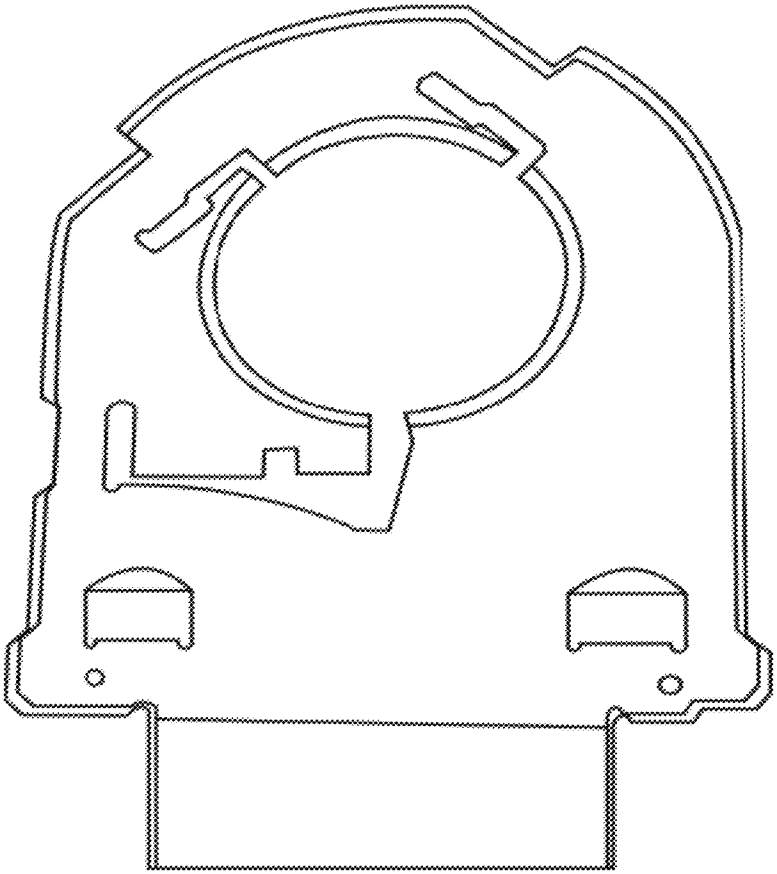
FIGS. 4 & 5 illustrate typical examples of disk carriers for Anelva sputtering tools, in accordance with an embodiment of the invention.
Figure 5:
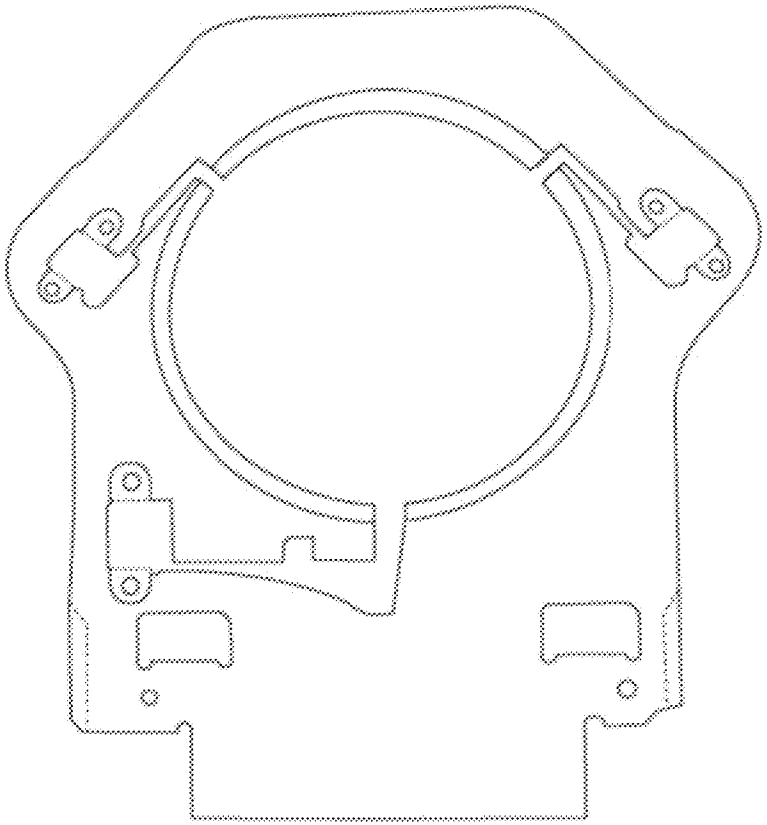

FIGS. 4 and 5 illustrate typical examples of disk carriers for Anelva sputtering tools, in accordance with an embodiment of the invention. Disk carriers are structures to hold the disks during sputtering process. For Example, magnetic disks are manufactured by sputtering on under layer, a magnetic layer film and a protective overcoat on a disk-shaped substrate. During sputtering process, the disk carrier carries the substrate (the target on which the sputtering process is performed) through several steps and thereafter the substrate is removed from the disk carrier.

Figure 6:
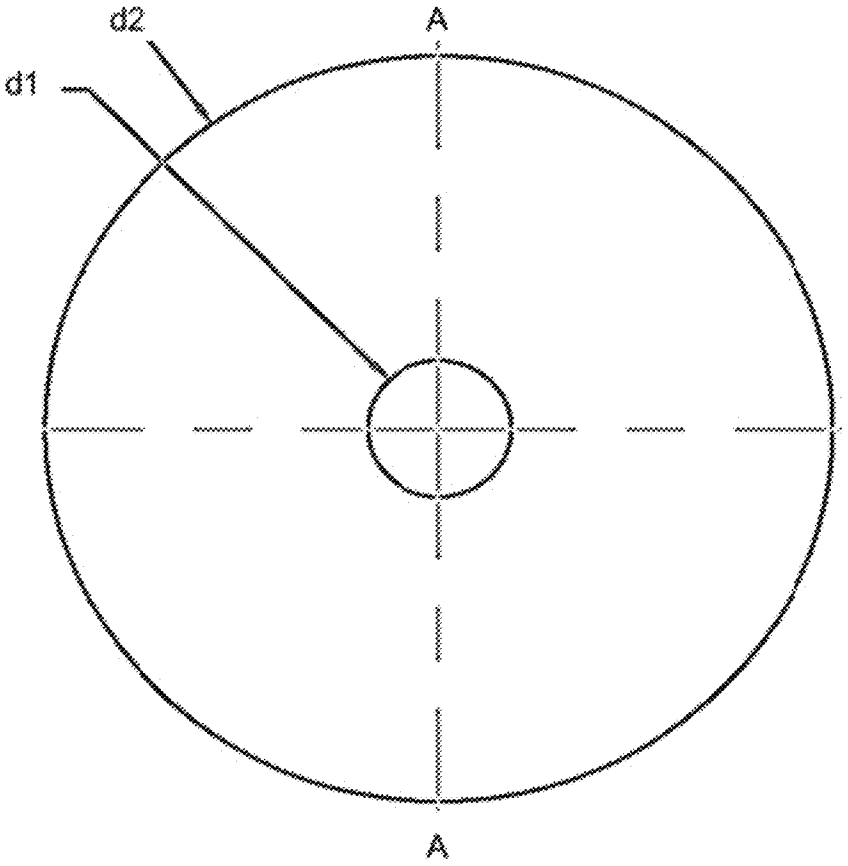
FIGS. 6(*a*) and (*b*) illustrate a design of an enhanced nozzle to be used in Twin Wire Arc Spray method, in accordance with an embodiment of the invention.
Figure 6:
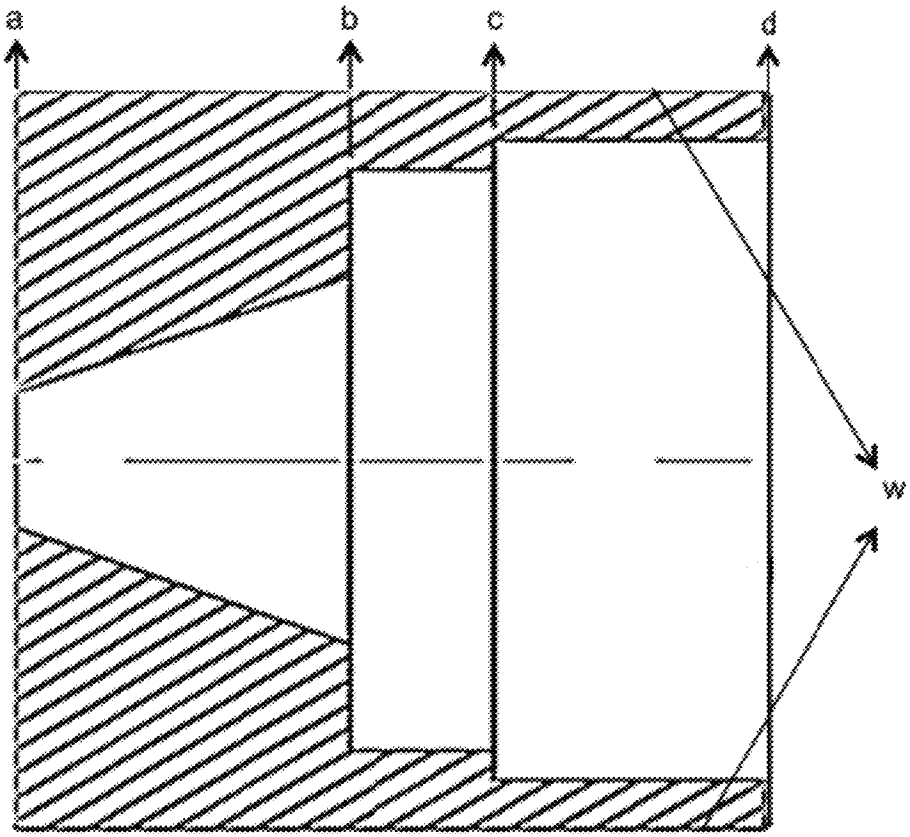

FIGS. 6(*a*) and (*b*) illustrate a design of enhanced nozzle to be used in a Twin Wire Arc Spray method, in accordance with an embodiment of the invention. Specifically, FIG. 6*a* shows the top view and FIG. 6*b* represents the side view of the enhanced nozzle that may be utilized in various steps of process for forming a porous metal coating on a substrate.

Twin wires arc spray process uses a nozzle to spray molten metal alloy over surface of the substrate (or a machine part) to be coated. The design of the enhanced nozzle, as in the FIGS. 6(*a*) and (*b*), may allow the same nozzle to be used for the various steps of the process. Effectively, the changing of nozzles for various steps of the process may be avoided. Further, the design of the nozzle may be efficient in lower and higher surfaces roughness (Ra) that may, furthermore, enable generating protective coatings with better uniformity and smoothness. In addition, it may make the process easier because it may allow the nozzle to work at lower air pressures. Moreover, this may protect the integrity and may avoid warping of the sprayed parts. Further, the nozzle diameter may be of range 0.5-4 mm and typically, the diameter may be of size about 1.5 mm. Section A in the FIG. 6(*a*) shows the top view of the nozzle, where the circumference of inner circle with diameter, d1, may be approximately 9.88 mm and of the outer circle with diameter, d2, may be approximately 53.92 mm.

Section A-A depicted in the FIG. 6(*b*) shows the side view of the nozzle, where the walls, 'w', of the nozzle may have threads. In the FIG. 6(*b*), 'b' may represent the distance or height of the converging portion of the nozzle from the front face of the nozzle, 'a'. Further, 'b' may have a value of 13.98 mm. Furthermore, 'c' may represent the distance from the front face of nozzle, which may be 19.98 mm. Also, 'd' may represent the distance of the outer circle with diameter, d2 (as shown in FIG. 6(*a*)), from the front face of the nozzle, which may be 31.52 mm.

Advantageously, the present invention may provide a thermal spraying process to produce a fine layer of protective porous coating over a required surface of a substrate. Specifically, thermal spraying process may be employed in creating a metal coating over the machine parts, such as sputtering machine parts, to avoid creation of flakes, particles and the like during the sputtering process, which otherwise may generate defects in sputtered substrate coating. Further, an alloy of Aluminium and Silicon, with preferred amount of Silicon in the alloy may be used in metal coating.

Advantageously, the addition of specific amount of Silicon may be efficient in improving the physical properties of the alloy and hence the metal coating. Preferably, 12% of the Silicon in the Al—Si alloy may impart efficient performance in the metal coating. Specifically, a more uniform coating layer may be achieved, that may further reduce the number of defects generated on sputtering substrate layers. A more rigid porous structure may be achieved with high roughness and smooth morphology that may prevent breakage of the structure while holding the sputtering layer and preventing the release of flakes and particles.

The addition of Silicon to the metals like Aluminium in creating a metal coating may turn out to be very efficient. Silicon may help in lowering the melting point of Aluminium. Further, it may allow high fluidity of the molten metal over the surfaces and create a uniform and smoother deposition. Further, the alloy may have slightly lower density (~2.65 g/cm$^3$), higher Young's modulus (~75 GPa) and may be harder (I.e., HV~430 MPa) than Aluminium alone. Furthermore, the alloy may have lower thermal expansion and may pose good resistance to corrosion and wear. Resultantly, the process of thermal spraying using Al—Si alloy with 12% Silicon may be efficient and produce a high performance metal coating over the surface, avoiding damages to the surface and generation of defects in the sputtering substrate coatings.

As one of ordinary skill in the art will appreciate, the example method described herein can be modified. For example, certain steps can be omitted, certain steps can be carried out concurrently, and other steps can be added. Although particular embodiments of the invention have been described in detail, it is understood that the invention is not limited correspondingly in scope, but includes all changes, modifications and equivalents coming within the spirit and terms of the claims appended hereto.

While the invention has been described in connection with what is presently considered to be the most practical and various embodiments, it is to be understood that the invention is not to be limited to the disclosed embodiments, but on the contrary, is intended to cover various modifications and equivalent arrangements included within the spirit and scope of the appended claims.

This written description uses examples to disclose the invention, including the best mode, and also to enable any person skilled in the art to practice the invention, including making and using any devices or systems and performing any incorporated methods. The patentable scope the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A process for forming a porous metal alloy sacrificial coating on a substrate, the process comprising:

a) thermally spraying an aluminum-silicon alloy spray from a twin wire arc spray (TWAS), within a composition range of 85-95% aluminum and 5-15% silicon, said alloy having a melting point of less than 600 degrees Celsius, through an enhanced nozzle comprising three sections in a first arc spray in a chemically reducing atmosphere onto the substrate to produce a first aluminum-silicon alloy coating of a first roughness of 200-400 Ra and a porosity of 40 to 80% thereon;

b) further providing a second aluminum-silicon twin wire arc spray in a chemically reducing atmosphere onto said first aluminum-silicon alloy coating to form a second aluminum-silicon coating having a roughness of 600-1100 Ra and 40 to 80% thereon;

c) mechanically treating the second aluminum-silicon alloy coating to create porous volume clean sites, free of remove loose particles to reopen pores after the second twin wire arc spray, and d) providing a finishing to said second aluminum-silicon alloy coating and creating rounded edges in the aluminum-silicon alloy coating to render a double aluminum-silicon alloy coating of a roughness average (Ra) from 600-1100 microinches, wherein the double aluminum-silicon alloy coating comprises silicon in the range of 5% to 15%.

2. The process as claimed in claim 1, wherein the aluminum-silicon alloy to be sprayed is in form of a wire, and the nozzle being at a non-perpendicular angle between 60 to 80 and 100 to 120 degrees to said substrate.

3. The process as claimed in claim 1, further comprising activating and cleaning said substrate prior to said twin wire arc spray (TWAS) step.

4. The process as claimed in claim 3, wherein said mechanical treating step applied on the coating after the said second twin wire arc spray (TWAS) step achieves a roughness root mean square height of said aluminum-silicon alloy coating in a range from 600 to 900 microinches.

5. The process as claimed in claim 1, wherein the first and second twin wire arc spray (TWAS) are accomplished with arc current in the range of about 35 to 200 amperes direct current (DC) and with arc voltage from about 15 to about 50 volts DC.

6. The process as claimed in claim 1, wherein said first and second twin wire arc spraying steps use a carrier gas at a pressure within range of about 400 to about 800 KPa.

7. The process as claimed in claim 1, wherein an aluminum-silicon alloy to be sprayed is in the form of a wire, where the wire has a diameter within range of gauge 14 to 16.

8. The process as claimed in claim 1, wherein an origin of said aluminum-silicon alloy spray is from 10 to 25 centimeters, from the surface the substrate to be coated and an angle of said metal alloy spray to the surface of the substrate is from 60 to 80 or 100 to 120 degrees.

9. The process as claimed in claim 1, wherein said first and second twin wire arc spray steps form a double aluminum-silicon alloy coating of 100 to 300 micrometers thickness.

10. A process according to claim 1, further comprising sand blasting said substrate prior to said twin wire arc spray step.

11. A process according to claim 1, wherein said twin wire arc spray (TWAS) comprises twin wires, and wherein each of each of said twin wires comprises 88% aluminum and 12% silicon.

12. A process according to claim 11, wherein said twin wires have a melting point of 575+/−1 degrees Celsius.

13. A process according to claim 1, wherein said first aluminum-silicon alloy coating has a hardness of 430 mPa.

14. A process according to claim 1, wherein said second aluminum-silicon alloy coating has a hardness of 430 mPa.

15. A process according to claim 14, wherein said double aluminum-silicon alloy coating has a hardness of 430 mPa.

16. A process according to claim 1, wherein said aluminum-silicon double metal alloy coating has a Young's Modulus of 75 GPa.

17. A process according to claim 1, wherein said aluminum-silicon double metal alloy coating has a density of less than 2.7 g/cm$^3$.

* * * * *